US009459035B2

(12) United States Patent
Buchstab et al.

(10) Patent No.: US 9,459,035 B2
(45) Date of Patent: Oct. 4, 2016

(54) REFRIGERATION DEVICE COMPRISING AN ICE DISPENSER, AND CORRESPONDING ASSEMBLY

(75) Inventors: Martin Buchstab, Bopfingen (DE); Irene Dumkow, Sontheim (DE); Adolf Feinauer, Giengen (DE); Klaus Flinner, Zöschingen (DE); Bernd Heger, Haunsheim (DE); Helen Lewis, Worcestershire (GB); Peter Nalbach, Kirchheim/Nabern (DE); Martin Pünjer, Ulm (DE); Craig Duncan Webster, Cambridgeshire (GB); Nathan Wrench, Cambridge (GB); Kasim Yazan, Ulm (DE)

(73) Assignee: BSH Hausgeraete GmbH, Hannover (DE)

( * ) Notice: Subject to any disclaimer, the term of this patent is extended or adjusted under 35 U.S.C. 154(b) by 1499 days.

(21) Appl. No.: 12/518,178

(22) PCT Filed: Nov. 22, 2007

(86) PCT No.: PCT/EP2007/062719

§ 371 (c)(1),
(2), (4) Date: Jun. 8, 2009

(87) PCT Pub. No.: WO2008/077704

PCT Pub. Date: Jul. 3, 2008

(65) Prior Publication Data

US 2010/0024461 A1 Feb. 4, 2010

(51) Int. Cl.

| | |
|---|---|
| ***F25C 5/02*** | (2006.01) |
| ***F25C 5/00*** | (2006.01) |
| ***F25C 5/04*** | (2006.01) |

(52) U.S. Cl.

CPC ..... *F25C 5/007* (2013.01); *F25C 5/005* (2013.01); *F25C 5/046* (2013.01); *F25C 2500/08* (2013.01)

(58) Field of Classification Search

CPC ..... F25C 1/00; F25C 5/00; F25C 5/007; F25C 5/043; F25C 5/046; F25C 5/18; F25C 5/187; F25C 5/002; F25C 5/005; F25C 2500/06; F25C 2500/08; F25D 2303/081

USPC ..... 62/344, 320, 340; 241/101.2

See application file for complete search history.

(56) References Cited

U.S. PATENT DOCUMENTS 3,059,450 A * 10/1962 Mueller ..... F25C 5/002 222/146.6
4,176,527 A * 12/1979 Linstromberg et al. ..... 62/320
4,176,627 A 12/1979 Bassi (Continued)

FOREIGN PATENT DOCUMENTS

DE 102005021556 A1 11/2006

*Primary Examiner* — Jonathan Bradford
(74) *Attorney, Agent, or Firm* — Laurence A. Greenberg; Werner H. Stemer; Ralph E. Locher

(57) ABSTRACT

A refrigeration device is provided that includes a housing enclosing an interior and an assembly in the interior having a storage compartment for chunks of ice and a stirrer. The stirrer is rotatable about an axis that extends through the storage compartment to move chunks of ice contained in the storage compartment in relation to each other and to move ice towards a dispensing passage that extends through the housing. A closable flap is interposed between the storage compartment and the dispensing passage.

15 Claims, 6 Drawing Sheets

(56) References Cited

U.S. PATENT DOCUMENTS

| | | | | | |
|---|---|---|---|---|---|
| 4,856,381 | A | | 8/1989 | Funahashi et al. | |
| 4,942,983 | A | * | 7/1990 | Bradbury | F25C 5/007 141/360 |
| 5,129,547 | A | * | 7/1992 | Fisher | F25C 5/002 222/1 |
| 5,273,219 | A | | 12/1993 | Beach, Jr. et al. | |
| 6,093,312 | A | | 7/2000 | Boulter | |
| 7,040,111 | B2 | | 5/2006 | Lee et al. | |
| 7,523,880 | B2 | | 4/2009 | Lee et al. | |
| 2004/0237569 | A1 | * | 12/2004 | Lee | F25C 5/005 62/353 |
| 2006/0202072 | A1 | * | 9/2006 | Lee | F25C 5/007 241/101.2 |
| 2006/0213213 | A1 | * | 9/2006 | Chung et al. | 62/344 |

* cited by examiner

Fig. 6
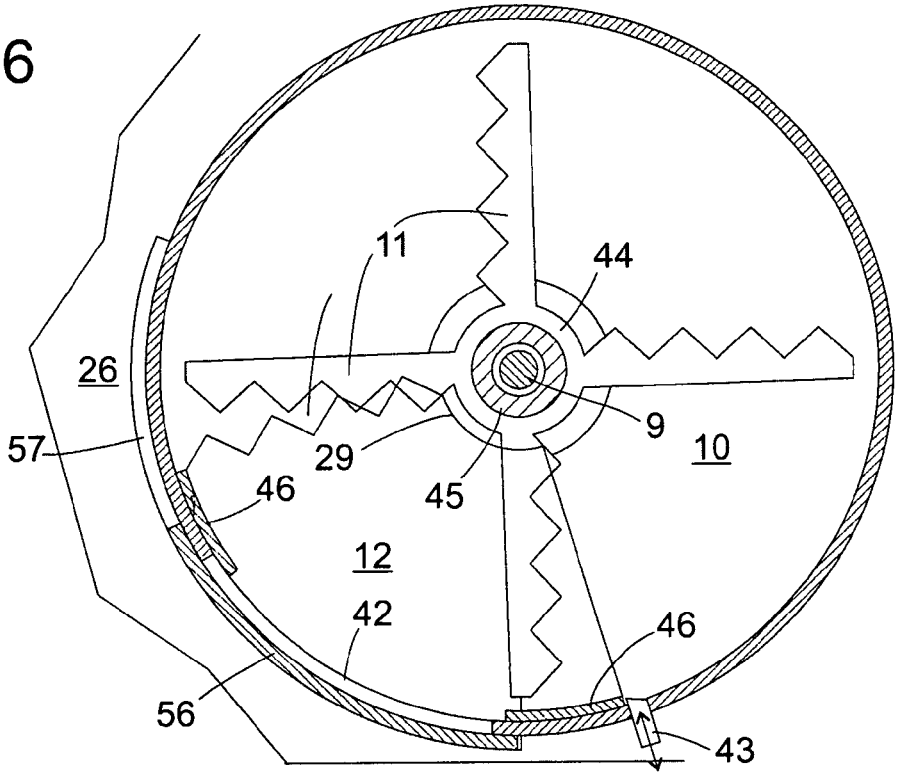
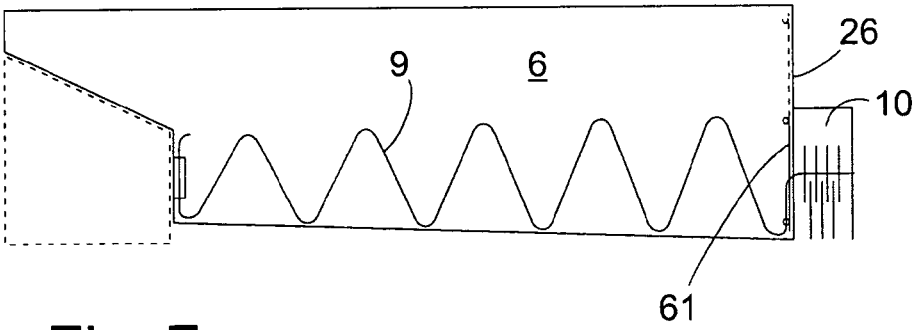
Fig. 7
Fig. 8
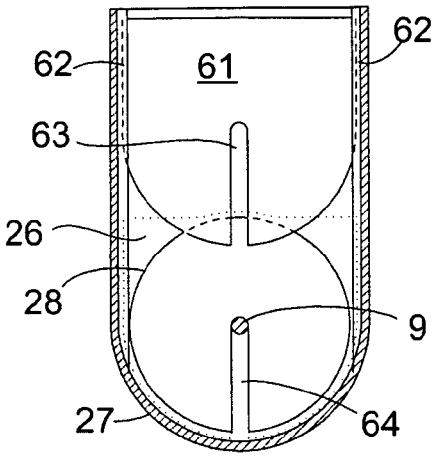

REFRIGERATION DEVICE COMPRISING AN ICE DISPENSER, AND CORRESPONDING ASSEMBLY

BACKGROUND OF THE INVENTION

The present invention relates to a refrigeration appliance, in particular a domestic freezer or fridge-freezer combination appliance, having an ice dispenser and an assembly for a refrigeration appliance of this kind.

An ice dispenser known from U.S. Pat. No. 4,176,627 A comprises a storage compartment for chunks of ice, a stirrer, which can be rotated about an axis extending through the storage container, a crushing compartment which lengthens the storage compartment in the direction of the axis, and a slide, rotatably coupled to the stirrer in the crushing compartment, in the form of a plurality of parallel blades secured to the axis, which during the course of its rotation conveys ice that has penetrated into the crushing compartment to a dispensing opening and optionally crushes it in the process. The stirrer is constructed over a portion of its length as a spiral and over another portion, adjacent to the dispensing compartment, as a conveyor worm, so a rotation of the stirrer conveys chunks of ice into the crushing compartment. If the stirrer were to rotate without it being possible to dispense ice from the crushing compartment, the ice would back up in the crushing compartment and block rotation. Rotation of the stirrer without simultaneous dispensing of ice is therefore not possible. If ice is not removed for a relatively long period of time there is the risk that the chunks of ice will freeze to one another in the storage container and block rotation, so the ice dispenser has to be removed from the refrigeration appliance and be de-iced in order to render it usable again.

U.S. Pat. No. 5,273,219 proposes an ice dispenser having an assembly that can be mounted in a refrigeration appliance, comprising a storage compartment for chunks of ice, a stirrer which can be rotated about an axis extending through the storage compartment in order to move chunks of ice contained in the storage compartment, and a dispensing compartment from which crushed or uncrushed chunks of ice are dispensed from the assembly as the user chooses. The stirrer has the form of a rod that is bent in the manner of a zigzag in one plane. A conveying and metering drum arranged between the storage compartment and the crushing compartment is coupled via a planet gear to the rotation of the stirrer and whenever the latter rotates conveys ice into the crushing compartment. The stirrer is therefore only allowed to rotate if ice is to be dispensed. The interval between successive actuations of the stirrer can therefore be very long and there is likewise the risk of chunks of ice freezing together in the storage compartment and blocking the stirrer.

To counteract the risk of the stirrer being blocked a very powerful drive motor can be provided for the stirrer and the entire assembly can be designed with high mechanical loading capacity to allow the chunks of ice to be broken off even after a period of relatively long non-use. While the risk of blocking of the ice dispenser may be reduced and/or the time of non-use following which a blockage occurs may be increased in this way, this approach is still associated with significant costs and there is the risk that chunks of ice will be undesirably crushed in the storage compartment. However, the greater the portion of small fragments of ice in the storage compartment is, the greater is its tendency to freeze solid and the greater the force required to break off the ice.

U.S. Pat. No. 4,856,381 proposes solving the problem of freezing solid by providing a stirrer and a conveyor worm in the storage compartment of an ice dispenser which are driven separately from each other and by a separate motor in each case. The stirrer can therefore be actuated to loosen chunks of ice from each other without ice simultaneously being dispensed through the conveyor worm. One problem with this construction is the large space requirement of the stirrer and the conveyor worm that is separate therefrom and their drive motors, which makes this solution of interest substantially only for commercial devices that are used exclusively for making ice.

BRIEF SUMMARY OF THE INVENTION

One object of the present invention is to create a refrigeration appliance comprising an ice dispenser in which freezing solid of stored chunks of ice can be reliably prevented and in which the ice dispenser still has a compact, inexpensively achievable construction. A further object is to disclose an assembly for a refrigeration appliance of this kind.

The object is achieved by a refrigeration appliance and assembly with the features of recited in the claims.

By arranging a closable flap between the storage compartment and the dispensing passage in a refrigeration appliance comprising a housing enclosing an interior, and an assembly arranged in the interior and having a storage compartment for chunks of ice and a stirrer, which is rotatable about an axis that extends through the storage compartment to move chunks of ice contained in the storage compartment in relation to each other and toward a dispensing passage that extends through the housing, it is possible to actuate the stirrer without this simultaneously leading to ice being dispensed. In other words, the stirrer, depending on the state—open or closed—of the flap can be used for conveying and dispensing ice or for loosening chunks of ice stored in the storage compartment. Arranging the flap on the path of the ice upstream of the dispensing passage, i.e. inside the chilled interior, ensures that ice which is potentially resting against the flap does not thaw and therefore thawed water does not flow in an uncontrolled manner out of the dispensing passage.

The closable flap is expediently part of the assembly.

To make the dispensing of crushed ice possible, the assembly preferably has a crushing compartment in which tools for crushing the chunks of ice are accommodated. In this case the flap can be arranged between the storage compartment and the crushing compartment, so when closed it prevents ice from passing into the crushing compartment. However, it can also be arranged between the crushing compartment and the dispensing passage. The second variant has the advantage that closing the flap immediately stops the dispensing of ice while a flap provided between storage compartment and crushing compartment cannot prevent ice that has already passed into the crushing compartment before the flap was closed from still being dispensed even after the flap has been closed.

The flap arranged between the crushing compartment and the dispensing passage is preferably arranged to close an opening in a circumferential surface of the substantially cylindrical crushing compartment. To convey ice through the crushing compartment the latter preferably contains a slide that can be rotated about its cylinder axis.

It is also preferred for the slide to have a first set of fingers, and for a second set of fingers to be provided in the dispensing compartment, at least one of the sets having at least two axially spaced fingers, and for one finger of the second set to pass a gap between the two fingers of the first set when the slide is rotated. Chunks of ice which arrive between two sets of fingers are crushed between the fingers and therefore arrive in the form of small fragments for dispensing. To improve conveying for crushing, the fingers preferably have sharp edges, in particular in the form of knife blades.

The flap can be displaceably guided between its open and closed positions.

To keep the construction of the assembly compact it may be expedient for the flap to be guided on a curved path.

To make such guidance possible it may be expedient for the flap to be flexible so as to correspond to the course of the curved path.

Alternatively the flap can also be pivoted about a first axis between its open and closed positions.

A flap of this kind can preferably be locked in its closed position by a self-locking mechanism.

A self-locking mechanism of this kind can easily be achieved by an arm that can be pivoted about a second axis, wherein in a position of the arm locking the flap, an imaginary line, which connects a point of the arm that contacts the flap to the second axis, is substantially parallel to the direction of movement of a point of the flap contacted by the point of the arm when the flap is not locked. The pivoting movement of the flap can be driven by a rotation of the arm, the flap always reaching an end point of its freedom of movement corresponding to the closed position, when the imaginary line is exactly parallel to the direction of movement of the contacted point. Small deviations from parallelism are acceptable as long as they do not lead to a marked open state of the flap in the locked state.

The arm can be rotated about the second axis without a stop. This allows for example the arm to be moved by rotations in the same direction respectively into the locking position and back into a non-locking position, and this simplifies the drive of the arm movement.

Alternatively the arm can be rotated about the second axis between two stops in an angular interval. While it is then necessary to be able to switch the direction of rotation of a drive for the arm, the need to monitor the position of the arm in order to detect when it is in the locking position is dispensed with. The angular interval in which the arm can be rotated expediently includes an orientation of the imaginary line exactly parallel to the direction of movement of the contacted point of the flap.

To be able to drive a movement of the flap in opposite directions the pivotable arm expediently engages in a connecting link formed on the flap.

BRIEF DESCRIPTION OF THE DRAWINGS

Further features and advantages of the invention result from the following description of exemplary embodiments with reference to the accompanying figures, in which:

FIG. 6 shows a section analogous to FIG. 4 according to a second embodiment;

FIG. 7 shows a longitudinal section of the assembly according to a third embodiment;

FIG. 8 shows a view of an end wall of a storage compartment of the assembly shown in FIG. 7 and a flap that can be displaced on the end wall;

DETAILED DESCRIPTION OF THE PRESENT INVENTION

Figure 1:
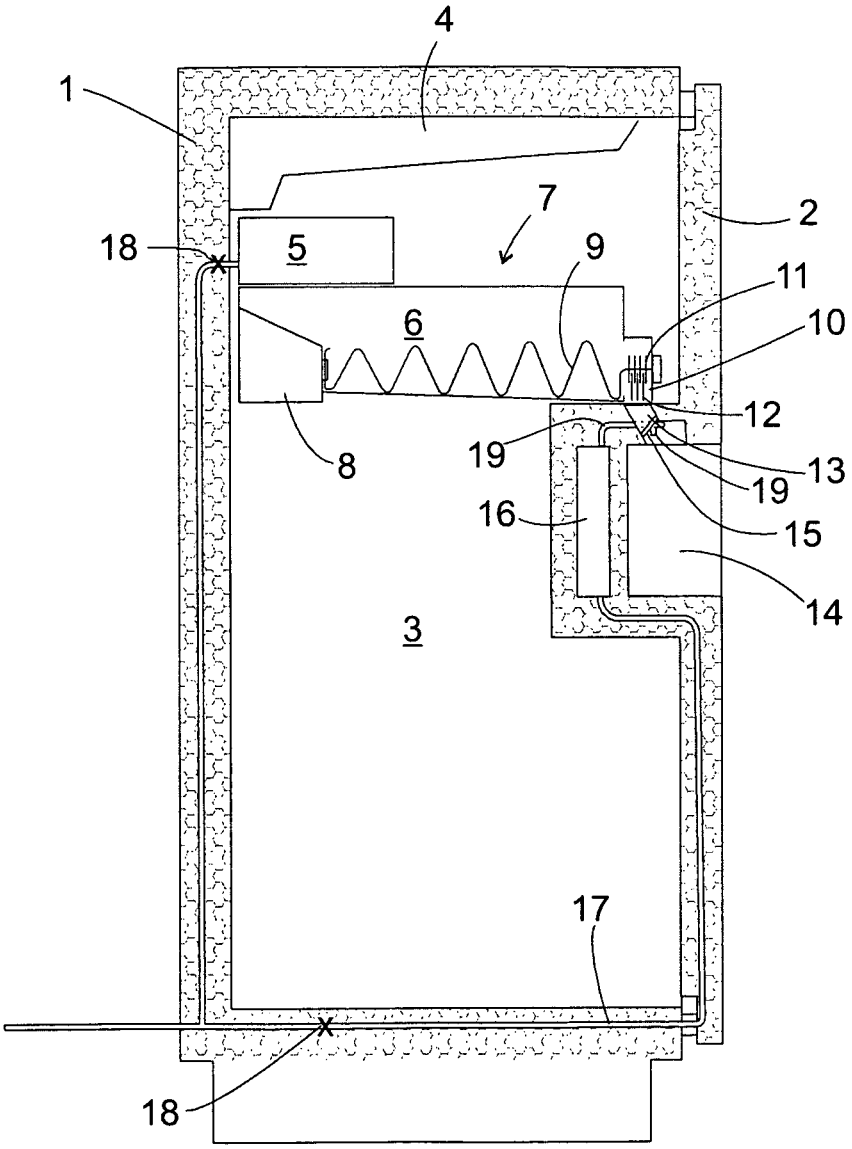
FIG. 1 shows a schematic section through a domestic refrigeration appliance which is equipped with an assembly according to the invention.

The refrigeration appliance shown in a schematic section in FIG. 1 has a heat-insulating body 1 and a door 2 which limit an interior 3. The interior 3 is kept at a temperature below 0° C. by an evaporator which is accommodated in an evaporator compartment partitioned in the upper region of the body 1. An automatic ice maker 5 is arranged in the interior 3 in the immediate vicinity of the evaporator compartment 4, so it can preferably be subjected to the action of cold air from the evaporator compartment 4. In a manner known per se but not shown in detail in the figure the ice maker 5 comprises a plurality of shaped containers, means for automatically metering water into the shaped containers and means for automatically ejecting the finished chunks of ice from the shaped containers. A storage compartment 6, open at the top, of an assembly constructed as assembly 7 is arranged below the ice maker 5 and receives the ejected chunks of ice. The assembly 7 extends over a large portion of the depth of the interior 3 and can for example be injection-molded in one piece from plastics material or be assembled from a plurality of injection-molded elements. An electric motor for driving a stirring rod 9 is accommodated in a rear recess 8 of the assembly 7. The electric motor can be permanently mounted in the refrigeration appliance or it can be integrated in the assembly and be removed therewith. The stirring rod 9 extends in the depth direction of the interior 3 or through the storage compartment 6 in the longitudinal direction thereof and through a crushing compartment 10 adjacent to the door 2 and which adjoins the storage compartment 6.

The stirring rod 9 is a metal rod which in its portion extending through the storage compartment 6 is bent in the manner of a zigzag in a plane parallel to its axis of rotation. Blades 11 of a grinder are secured to the portion of the stirring rod 9 engaging in the crushing compartment 10, so they rotate when the stirring rod 9 is rotated.

Figure 3:
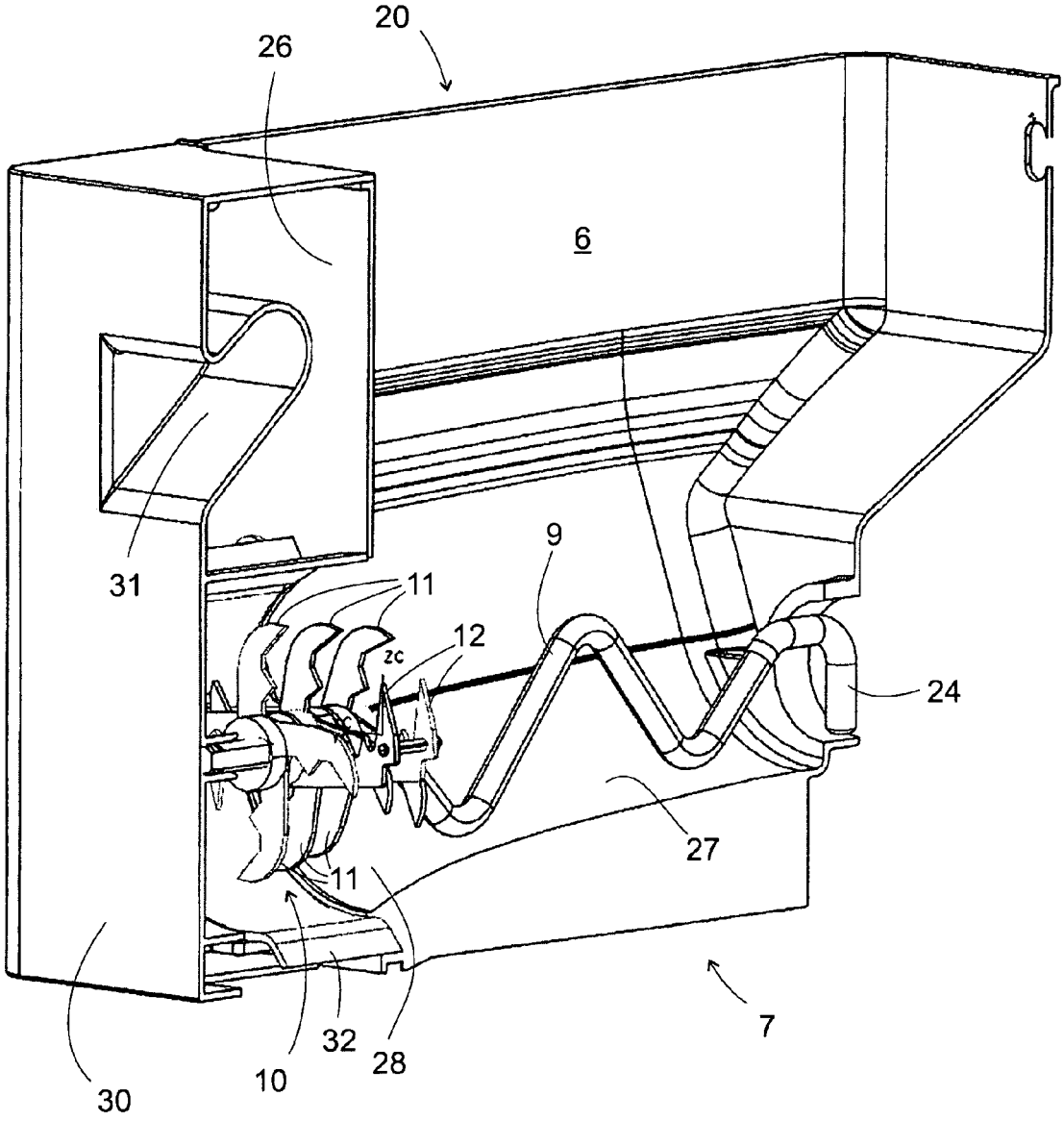
FIG. 3 shows a perspective view of a complete assembly halved along the same plane.
Figure 4:
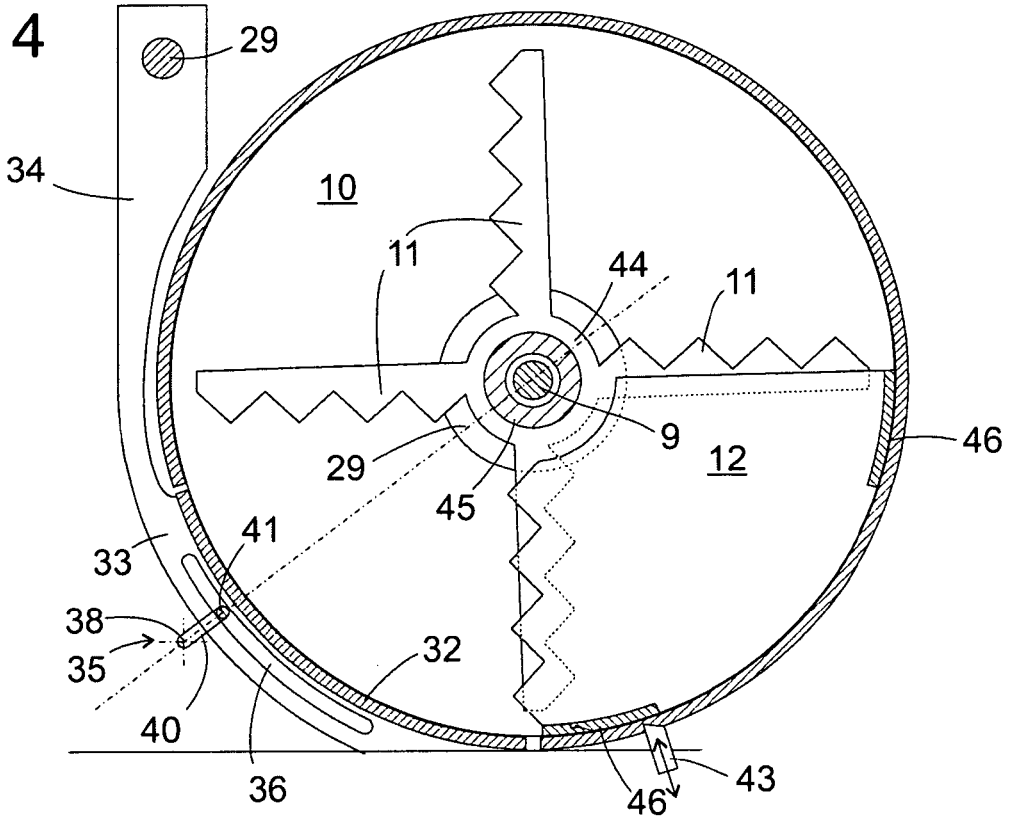
FIG. 4 shows a section through the crushing compartment of the assembly shown in FIG. 3 when the flap is closed.
Figure 5:
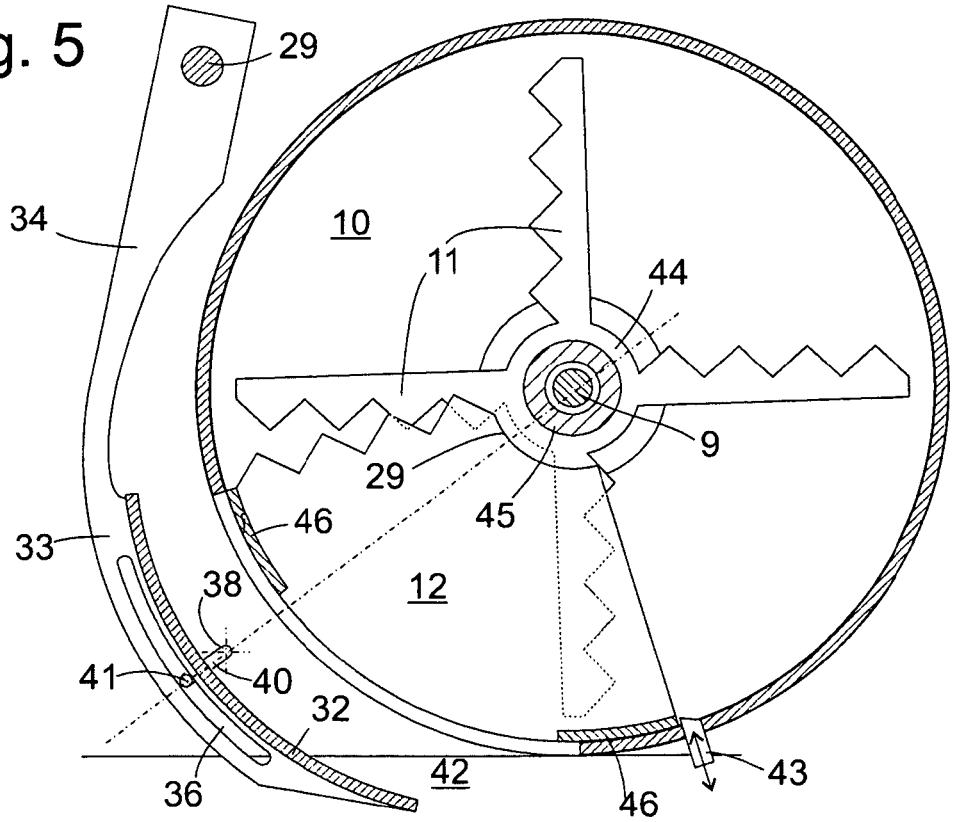
FIG. 5 shows a section through the crushing compartment when the flap is open.

As may be seen in particular in FIGS. 3 to 5, the crushing compartment 10 substantially has the shape of a recumbent cylinder in which the portion of the stirring rod 9 supporting the blades 11 extends coaxially. Four blades 11 respectively are formed in one piece on a blade disc 44 and a plurality of blade discs 44 are attached in a non-rotatable manner one behind the other on the stirring rod 9. Two resilient impact rings 45 spaced apart by a gap are arranged respectively on the stirring rod between two adjacent blade discs 44 (see FIG. 10).

Figure 10:
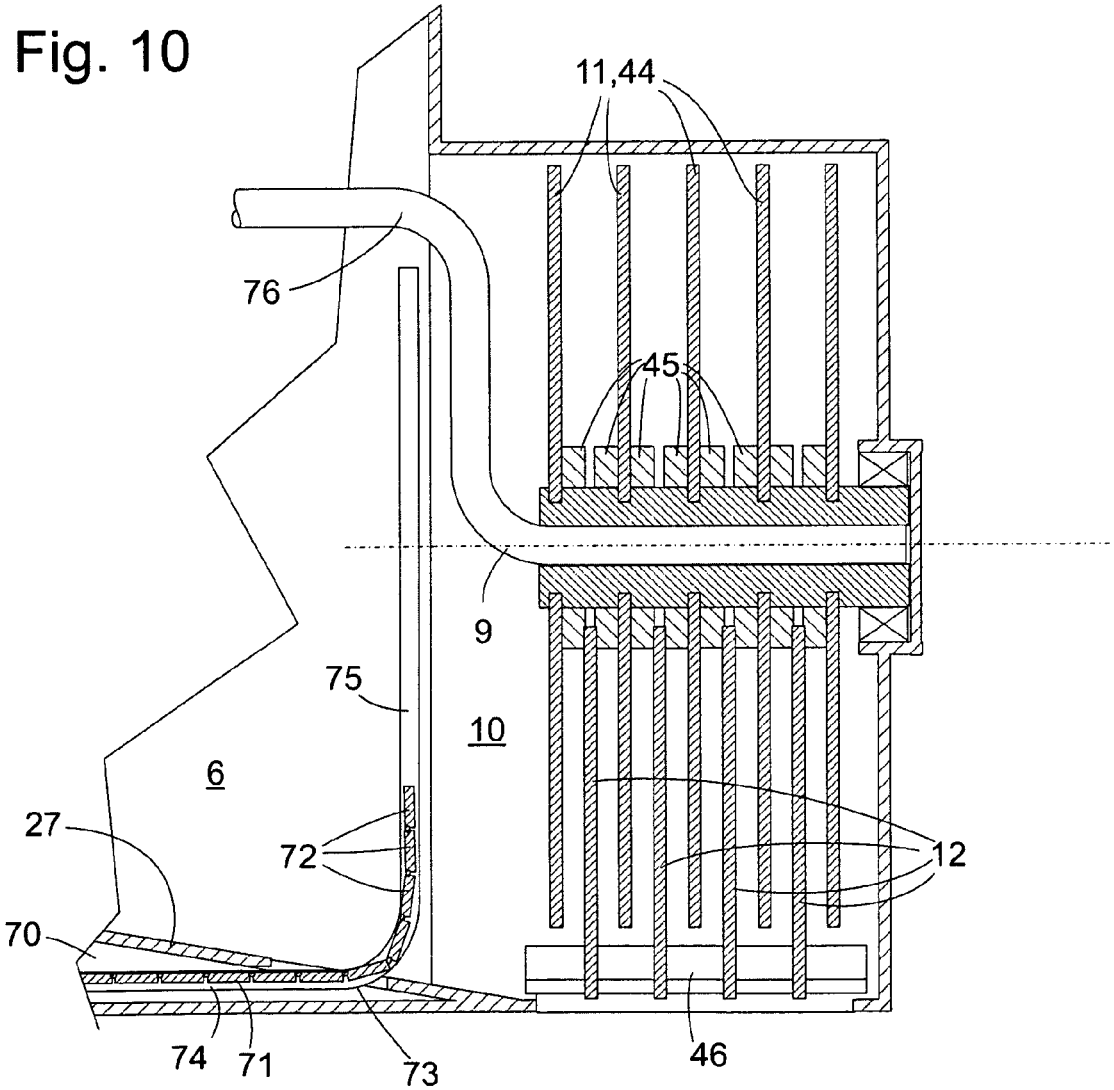
FIG. 10 shows a section through an enlarged detail of an assembly according to a fifth embodiment.

Blades 12 are also accommodated in the crushing compartment 11 and can be switched between a state in which they can be rotated together with the blades 11 in which, like these, they merely act as slides for the chunks of ice located in the crushing compartment 10, and a stationary state in which they grind ice located in the crushing compartment 10 in cooperation with the blades 11. The blades 12 have the form of sharp-edged, substantially quadrant-shaped plates. At their outer circumference the plates are rigidly connected by two cross struts 46 and their tips that face the stirring rod 9 are clamped in the gaps between the impact rings 45, as shown in FIG. 10. The clamping is so firm that the blades 12 are carried along by the rotation of the stirring rod 9 if they are not prevented from doing so by a bar 43 (see FIGS. 4, 5) which acts on one of the cross struts 46 through an opening in the wall of the crushing compartment 10.

A flap (not visible in FIG. 1) is provided on the cylindrical outer wall of the crushing compartment 10; the various embodiments will be described in more detail below. If the flap is open a rotation of the stirring rod 9 conveys ice from the storage compartment 6 into the crushing compartment 10, optionally depending on the position of the bar 43, the ice is crushed in the crushing compartment 10 and dispensed though a passage 13, which extends through an layer of insulating material of the door 2 and ends in a recess 14 that is open toward the outside of the door 2. An additional flap 15 normally keeps the passage 13 closed to prevent hot air from penetrating into the interior 3. The flap 15 is kept open only for as long as the stirring rod 9 rotates in order to dispense ice through the passage 13 into a container placed in the recess 14.

A water tank 16 is embedded in the insulating material of the door 2 on the back wall of the recess 14. Like the ice maker 5 the water tank 16 is connected on the one hand via a supply line 17 and a stop valve 18 to the drinking water network and on the other hand to a tap connection 19 in the recess 14.

Figure 2:
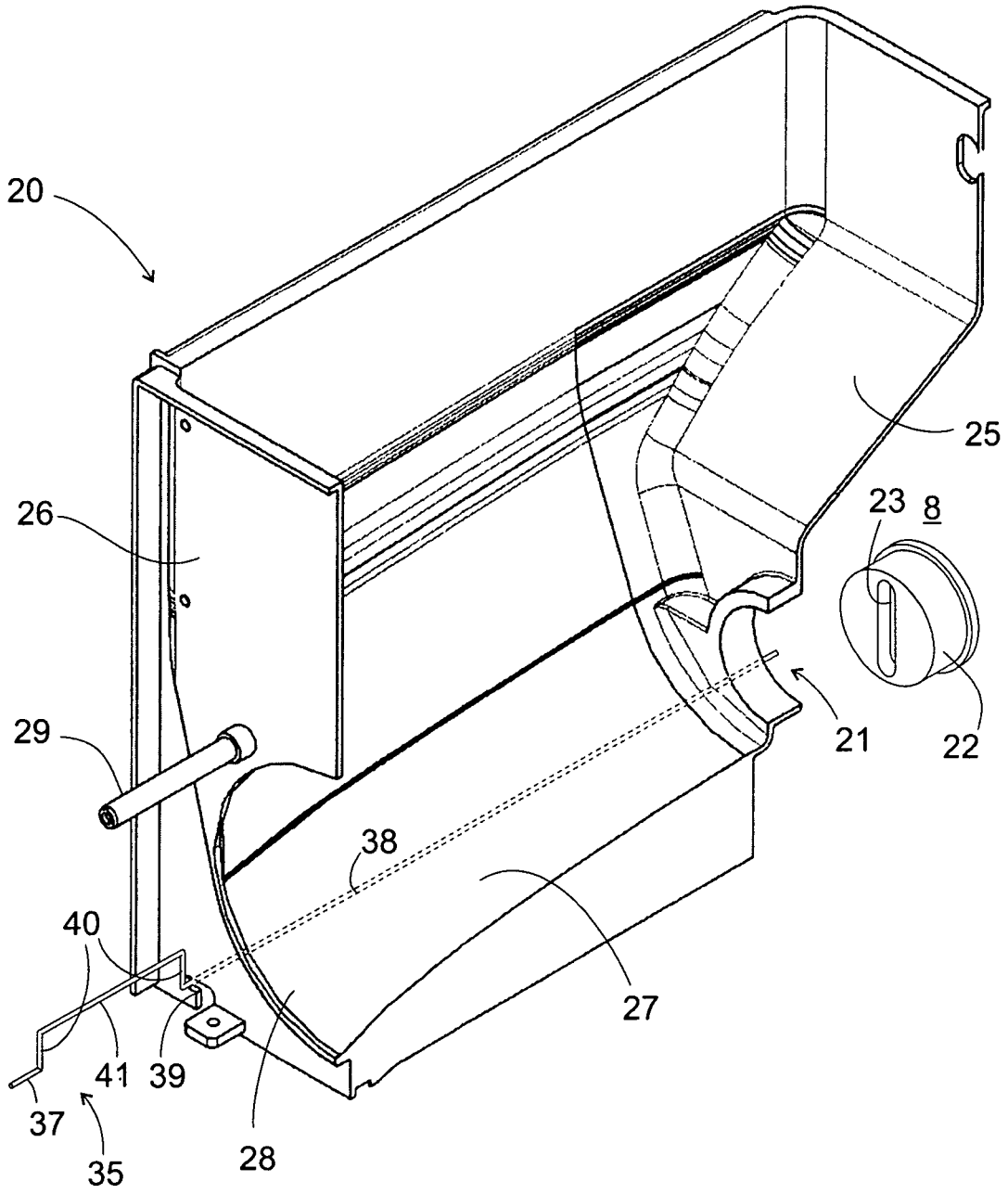
FIG. 2 shows a perspective view of a storage compartment of the assembly halved along a centre plane.

FIG. 2 shows a perspective view of a shell 20 of the assembly 7 which together with a counterpart (not shown) that is substantially mirror-symmetrical to it limits the storage compartment 6. The recess 8 that receives the motor (not shown) can be seen on a back of the shell 20. A cutout on a back wall 25 of the shell 20 facing the recess 8, together with its counterpart, forms a circular window 21 which is provided to rotatably receive a substantially cylindrical coupling piece 22. On its front facing the viewer in FIG. 2 the coupling piece 22 has a slit 23 into which an angled end portion 24 (see FIG. 3) of the stirring rod 9 can be inserted. Cutouts (not shown) on the back of this coupling piece 22 allow positive engagement of the motor.

The storage compartment 6 has a base 27 that slopes in the longitudinal direction from the back wall 25 to an end wall 26 and is semi-circular in the section transverse to the axis of rotation of the stirring rod 9. The semi-circular cross-sectional shape of the base 27 prevents chunks of ice from becoming wedged in a corner of the storage compartment 6 and being able to block rotation of the stirring rod 9. The sloping course toward the end wall 26 means that chunks of ice set in motion as a result of the rotation of the stirring rod 9 tend to slide toward the end wall 26 and via a circular window 28 formed therein enter the crushing compartment 10 (not shown in FIG. 2).

A pin 29 that projects forward from the end wall 26 is used as a pivot axis for the flap which closes the crushing compartment 10 and has already been mentioned.

FIG. 3 again shows the shell 20, the stirring rod 9 with the angled end portion 24 and the blades 11, 12 as well as, centrally halved, a leading housing part 30 which forms the walls of the crushing compartment 10. A cutout 31 formed in the end face of the housing part 20 above the crushing compartment 10 is used as a gripping recess to facilitate removal of the assembly 7 from the interior 3.

FIG. 4 shows a section through the crushing compartment 10 across the axis of rotation of the stirring rod 9, the flap, designated here by 32, closing the crushing compartment 10 being shown in the closed position. In this position the flap 32 exactly fills an opening formed in the cylindrical outer wall of the crushing compartment 10. A rib 33 protrudes from the outer surface of the flap 32 and is extended to an arm 34 positioned in a pivotable manner on the pin 29. The flap 32 is held in the closed position by a self-locking mechanism which is formed here by a toggle lever 35 cooperating with a slot 36 of the rib 33 that acts as a connecting link (see FIG. 2). The toggle lever 35 has two end portions 37, 38 that are collinear to each other, of which one, 37, is rotatably held in a cutout (not shown) of the leading housing part 30 and the other, 38, is received in a slit 39 in the end wall 26. Two lever arms 40 connect the end portions 37, 38 respectively to an eccentric portion 41 of the toggle lever 35 extending through slot 36.

In the configuration shown in FIG. 4 the axis of rotation of the toggle lever 35, defined by the end portions 37, 38, the eccentric portion 41 and the axis of rotation of the stirring rod 9, lie in an identical plane, shown by a dash-dot line in FIG. 4. A pressure acting from the inside against the flap 32, which can occur for example if ice is jammed between the rotating blades 11 and the flap 32, is absorbed by the toggle lever 35 and guided into the end wall 26 and the leading housing part 30 in such a way that no appreciable torque occurs which could force the toggle lever 35 out of its position. By occasionally rotating the stirring rod 9 when the flap is closed it is therefore possible to prevent the chunks of ice from freezing to each other in the storage compartment 6 without ice simultaneously being dispensed.

FIG. 5 shows the crushing compartment 10 when the flap 32 is open. The toggle lever 35 is rotated by 180° with respect to the position shown in FIG. 4, so an opening 42 forms in the lower region of the crushing compartment 10, through which opening it is possible to dispense ice into the passage 13. Because the eccentric portion 41 of the toggle lever 35 engages in the slot 36, tensile force can also be exerted on the flap 32 when the toggle lever 35 is rotated so the flap can optionally even be opened if it is frozen in places to the wall of the crushing compartment 10.

In the configuration shown in FIG. 5 the blades 12 are fixed by the displaceable bar 43 in a position bridging the opening 42, so ice which has penetrated into the crushing compartment 10 is crushed between the blades 11, 12 before it passes the opening 42. If the bar 43 is withdrawn from the crushing compartment 10, the blades 12 rotate together with blades 11, so as a result of simultaneous rotation of the stirring rod 9 chunks of ice which have passed into the crushing compartment 10 are dispensed intact through the opening 42.

FIG. 6 shows a section analogous to FIG. 4 through the crushing compartment 10 according to a second embodiment of the invention. The pivotable flap 32 is replaced here by a displaceable flap 56. The flap 56 bent in the shape of an arc can be displaced in grooves 57 on the end wall 26 of the shell 20 and the leading housing part 30 (not shown in FIG. 6) between the illustrated position, in which it covers the opening 42 of the crushing compartment 10, and an open position, in which it rests on a wall region of the crushing compartment 10 that is adjacent to the opening 42. Construction and operation of the blades 11, 12 are the same as in the first embodiment.

FIG. 7 shows a schematic section through the assembly 7 according to a third embodiment of the invention. Whereas a flap 32 and 56 was provided respectively at an exit of the crushing compartment 10 in the two previously described embodiments, in the embodiment in FIG. 7 a flap 61 can be vertically displaced in the storage compartment 6 on its end wall 26. FIG. 8 shows a view of the end wall 26 seen from the inside of the storage compartment 6. The flap 61 is shown in a raised, open position as a solid outline. Lateral edges 62 of the flap are guided in vertical grooves. In its lower half the flap 61 has a rounded contour matched to the course of the base 27 of the storage compartment 6. A vertical slit 63 in the lower half of the flap 61 allows the flap 61 to be pushed downwards beyond the stirring rod 9 extending through the window 28 of the end wall 26, until it substantially closes the window 28 in the position shown as a dotted outline. The end wall 26 can be provided with a web 64 projecting from below into the window 28 and filling the slit 63, when the flap 61 is in the lowered, closed position.

It is not always possible to lower the flap 61 when the stirring rod 9 is idle because chunks of ice are generally located in the region of the window 28 and will block the path of the flap 61. However, by rotating the stirring rod 9 during lowering of the flap 61 it is possible to lower the flap 61 gradually until the window 28 is completely closed.

Figure 9:
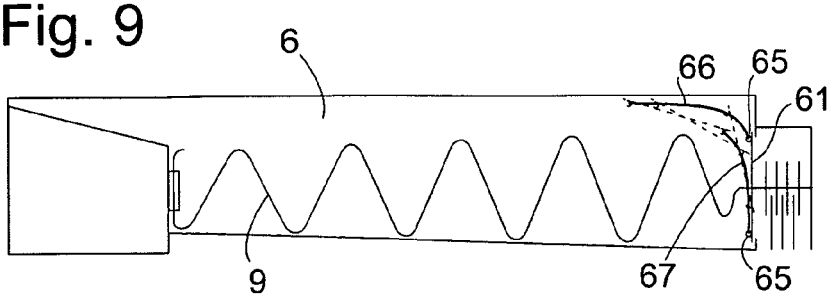
FIG. 9 shows a longitudinal section through an assembly according to a fourth embodiment.

FIG. 9 shows a schematic diagram analogous to FIG. 7 of the assembly according to a fourth embodiment of the invention. In this embodiment the height of the storage compartment 6 is reduced compared with the embodiment in FIG. 7, so it is not possible to raise a flap 61 closing the window 28 of the end wall 26 in a straight line in order to open the window 28. In the embodiment in FIG. 9 the flap 61 is therefore provided at its edges with two protruding pegs 65 respectively which are guided in curved grooves 66, 67, schematically shown as dashes in FIG. 9. The course of the grooves 66, 67 is fixed such that the flap 61 is transferred on a curved path from its vertical position closing the window 28 into a continuously less inclined position.

FIG. 10 shows a section through the crushing compartment 10 and its surroundings according to a fifth embodiment of the assembly 7. A receiving compartment 70 for a flap 71 is formed below the base 27 of the storage compartment 6 that slopes toward the crushing compartment 10 and, like a roller shutter, is assembled from a large number of longitudinally stiff webs 72 that are flexibly connected to each other. The webs 72 can each be of one-piece construction and be connected for example by foil hinges. They are guided in two opposing grooves 73 in the two shells 20 which each comprise a substantially horizontal leg 74 inside the receiving compartment 70 and a vertical leg 75 extending in front of the window 28 of the end wall 26. Chunks of ice which are located between the two vertical legs 75 as the flap 71 is closed can move upward to avoid the pressure of the flap 71, so there is no risk of the movement of the flap 71 being blocked. It is therefore not necessary to rotate the stirring rod 9 during opening and closing of the flap 71. In the plane defined by the vertical legs the stirring rod 9 therefore has a very eccentric portion 76, and a rotation of the stirring rod 9 will always end in an orientation in which the eccentric portion 76 is located at the highest point of its course, as shown in FIG. 10. In this position the stirring rod 9 does not impede closing of the flap 71 either and no slit which weakens the flap, like slit 63 in FIG. 8, is required to allow the flap 71 to close.

The invention claimed is:

1. A refrigeration appliance comprising:

a housing enclosing an interior;

a dispensing passage that extends through the housing;

an assembly arranged in the interior, the assembly having a storage compartment for chunks of ice and a stirrer, the stirrer being rotatable about an axis that extends through the storage compartment to move the chunks of ice contained in the storage compartment in relation to each other and to move the chunks of ice toward the dispensing passage;

a crushing compartment for crushing the chunks of ice therein, the crushing compartment having an opening formed therein, the opening leading to the dispensing passage;

a closable flap completely filling the opening and closing the opening and preventing the chunks of ice from entering the dispensing passage, the closable flap preventing the chunks of ice which are potentially resting against the closable flap from thawing and flowing in an uncontrolled manner out of the dispensing passage;

a self-locking mechanism for locking the closable flap in a closed position, the self-locking mechanism having an arm pivotable about an axis, the flap opening due to movement of the arm, the arm having a rib with a slot formed therein; and a toggle lever, the slot cooperating with the toggle lever, the toggle lever having two end portions that are coaxial with one another that define a lever axis of rotation, each of the end portions having a respective lever arm connecting the end portions to an eccentric portion of the toggle lever, the lever axis of rotation, the eccentric portion and the axis of the stirring rod lying in a common plane in a closed position of the closeable flap.

2. The refrigeration appliance as claimed in claim 1, wherein the closable flap is part of the assembly.

3. The refrigeration appliance as claimed in claim 2, wherein the crushing compartment has a set of blade fingers accommodated therein.

4. The refrigeration appliance as claimed in claim 3, wherein the opening is in a circumferential surface of a substantially cylindrical portion of the crushing compartment.

5. The refrigeration appliance as claimed in claim 4, wherein the crushing compartment contains a slide that is rotatable about a cylinder axis of the substantially cylindrical portion of the crushing compartment.

6. The refrigeration appliance as claimed in claim 5, further comprising a subset of blade fingers having at least two axially spaced fingers delimiting a gap there between, and a finger from the set of blade fingers is configured to pass between the gap during the rotation about the axis when the subset of blade fingers are stationary.

7. The refrigeration appliance as claimed in claim 1, wherein the flap is displaceably guided between an open position and a closed position.

8. The refrigeration appliance as claimed in claim 1, wherein the flap is pivotable about a first axis between an open position and a closed position.

9. The refrigeration appliance as claimed in claim 1, wherein the arm is rotatable about the arm axis between two stops in an angular interval.

10. The refrigeration appliance as claimed in claim 1, wherein the arm of the self-locking mechanism engages in a connecting link formed on the flap.

11. The refrigeration appliance as claimed in claim 1, wherein the slot is an elongated slot.

12. The refrigeration appliance as claimed in claim 1, wherein the eccentric portion extends through the slot, one of the end portions is disposed in an end wall of the storage compartment and a remaining one of the end portions is disposed in a leading housing part of the crushing compartment.

13. An assembly of a refrigeration appliance, the assembly comprising:

a storage compartment for chunks of ice;

a stirrer, the stirrer being rotatable about an axis that extends through the storage compartment to move the chunks of ice contained in the storage compartment in relation to each other and to move the chunks of ice toward a dispensing passage that extends through a housing;

a crushing compartment for crushing the chunks of ice therein, the crushing compartment having an opening formed therein, the opening leading to the dispensing passage;

a closable flap completely filling the opening and closing the opening and preventing the chunks of ice from entering the dispensing passage, the closable flap preventing the chunks of ice which are potentially resting against the closable flap from thawing and flowing in an uncontrolled manner out of the dispensing passage;

a self-locking mechanism for locking the closable flap in a closed position, the self-locking mechanism having an arm pivotable about an axis, the flap opening due to movement of the arm, the arm having a rib with a slot formed therein; and a toggle lever, the slot cooperating with the toggle lever, the toggle lever having two end portions that are coaxial with one another that define a lever axis of rotation, each of the end portions having a respective lever arm connecting the end portions to an eccentric portion of the toggle lever, the lever axis of rotation, the eccentric portion and the axis of the stirring rod lying in a common plane in a closed position of the closeable flap.

14. The refrigeration appliance as claimed in claim 13, wherein the crushing compartment has a set of blade fingers accommodated therein.

15. A refrigeration appliance comprising:

a housing enclosing an interior;

a dispensing passage that extends through the housing;

an assembly arranged in the interior, the assembly having a storage compartment for chunks of ice and a stirrer, the stirrer being rotatable about an axis that extends through the storage compartment to move the chunks of ice contained in the storage compartment in relation to each other and to move the chunks of ice toward the dispensing passage;

a crushing compartment for crushing the chunks of ice therein, the crushing compartment having an opening formed therein, the opening leading to the dispensing passage;

a closable flap disposed between the crushing compartment and the dispensing passage;

a self-locking mechanism for locking the closable flap in a closed position, the self-locking mechanism having an arm pivotable about an axis, the flap opening due to movement of the arm, the arm having a rib with a slot formed therein; and a toggle lever, the slot cooperating with the toggle lever, the toggle lever having two end portions that are coaxial with one another that define a lever axis of rotation, each of the end portions having a respective lever arm connecting the end portions to an eccentric portion of the toggle lever, the lever axis of rotation, the eccentric portion and the axis of the stirring rod lying in a common plane in a closed position of the closeable flap.

* * * * *